United States Patent [19]

Synofzik et al.

[11] Patent Number: 4,722,282

[45] Date of Patent: Feb. 2, 1988

[54] PAYLOAD-CARRYING PROJECTILE

[75] Inventors: Reinhard Synofzik, Jüchen; Rolf Hellwig, Neuss, both of Fed. Rep. of Germany

[73] Assignee: Rheinmetall GmbH, Düsseldorf, Fed. Rep. of Germany

[21] Appl. No.: 937,029

[22] PCT Filed: Jan. 31, 1986

[86] PCT No.: PCT/EP86/00043

§ 371 Date: Nov. 10, 1986

§ 102(e) Date: Nov. 10, 1986

[87] PCT Pub. No.: WO86/05266

PCT Pub. Date: Sep. 12, 1986

[30] Foreign Application Priority Data

Mar. 9, 1985 [DE] Fed. Rep. of Germany ..... 3508453

[51] Int. Cl.[4] ..... F42B 11/18; F42B 11/00

[52] U.S. Cl. ..... 102/513; 102/293; 102/501; 102/505; 343/888

[58] Field of Search ..... 102/501, 401, 293, 513, 102/505; 367/3, 4, 153, 155, , 165, 173; 343/888, 705

[56] References Cited

U.S. PATENT DOCUMENTS

| | | | |
|---|---|---|---|
| 3,448,456 | 6/1969 | Pessin . | |
| 3,523,658 | 8/1970 | Marshall . | |
| 3,634,863 | 1/1972 | Dow . | |
| 3,986,159 | 10/1976 | Horn | 367/4 |
| 3,990,123 | 11/1976 | Stachiw et al. | 367/173 |
| 4,292,861 | 10/1981 | Thornhill, Jr. et al. | 102/401 |
| 4,448,106 | 5/1984 | Knapp | 102/513 |

FOREIGN PATENT DOCUMENTS

| | | |
|---|---|---|
| 153444 | 9/1985 | European Pat. Off. . |
| 3237486 | 4/1984 | Fed. Rep. of Germany . |
| 3237485 | 4/1984 | Fed. Rep. of Germany . |
| 2317624 | 2/1977 | France . |
| 8600980 | 2/1986 | World Int. Prop. O. . |

*Primary Examiner*—Harold J. Tudor

*Attorney, Agent, or Firm*—Spencer & Frank

[57] ABSTRACT

A payload-carrying projectile 1 includes a sensor 16 and a sensor carrier 15 disposed in a launch-resistant manner in a recess 14 in the tail section 11 of the projectile 1. After impact of the projectile, which is stabilized by extendable vanes 12, in the target area, where it may penetrate the ground as necessary, the object is to deploy the sensor from its protected position inside the projectile 1and to place it as high as possible above the surface of the ground. For this purpose, the sensor 16 is connected with a concertina bellows 15 which for its part leads into a reservoir 13*a* which is disposed in the projectile, and which is filled with polyurethane foam mixed with a propellant gas under high pressure. The connection of the reservoir 13 with the concertina bellows 15 is made via a valve 13*c* which is regulated by an electronic control element 13*a* containing, for instance, a timer switch. After the opening of the valve 13*c* the polyurethane foam 17 enters the concertina bellows 15 and expands it, thereby expelling the sensor 16 from the recess 14. Finally, the polyurethane foam 17 hardens, so that the now extended concertina bellows 15 provides a safe support for the deployed sensor 16.

14 Claims, 4 Drawing Figures

PAYLOAD-CARRYING PROJECTILE

BACKGROUND OF THE INVENTION

The invention relates to a payload-carrying projectile of the type which is provided with a sensor which cooperates with the payload.

Since modern combat field artillery has become capable of achieving ever increasing effective ranges of 40 km or more, improved reconnaissance to achieve a more effective use of the weapons has become necessary. Furthermore, projectiles containing, for instance, mines as a payload are being developed which are fired over large distances for the purpose of interdiction of areas of terrain and the payload of which is only activated after a worthwhile target has entered the attack range. To satisfy these operational plans projectiles are equipped with intelligent sensors, which transmit the results of reconnaissance from the battle field and/or activate a payload either automatically or under remote control.

Strongly opposed demands must be satisfied in the construction of such projectiles. On the one hand the highly sensitive sensors have to be disposed in the projectile in a launch-resistant manner so that they can absorb the large acceleration forces occurring during firing and upon impact in the target area without damage. Large-caliber projectiles are, as is generally known, exposed during firing to forces of many thousand times the gravitational acceleration. On the other hand, after the projectile has reached the target area, the sensors have to be extended as high as possible above the surface of the ground in order to assure large detection range.

SUMMARY OF THE INVENTION

The object of the invention is to propose a payload-carrying projectile satisfying the above demands.

Based on a payload-carrying projectile of the type discussed in detail above, the above object is achieved according to the present invention by a projectile having a recess formed in its tail section, a sensor for the payload mounted on a sensor carrier, with the sensor and the sensor carrier being disposed, in a protected manner, in the recess during firing of the projectile and with the sensor carrier comprising a concertina type bellows having one end connected to the sensor, and being disposed in the recess in a compressed state; and means for deploying the sensor from the projectile including a reservoir which is disposed within the projectile which contains polyurethane foam mixed with a propellant gas under high pressure, and which is connected, via an opening which is closable by a valve element, with the other end of the concertina type bellows.

According to other features of the invention, the means for deploying further includes an electronic control element, which is disposed inside the projectile, for controlling the valve element to open same after impact of the projectile in a target area. The electronic control element can, for example, be a time delay switch and/or an impact switch.

Invention is described in detail below with reference to the drawings.

DETAILED DESCRIPTION OF THE PREFERRED EMBODIMENT

Figure 1:
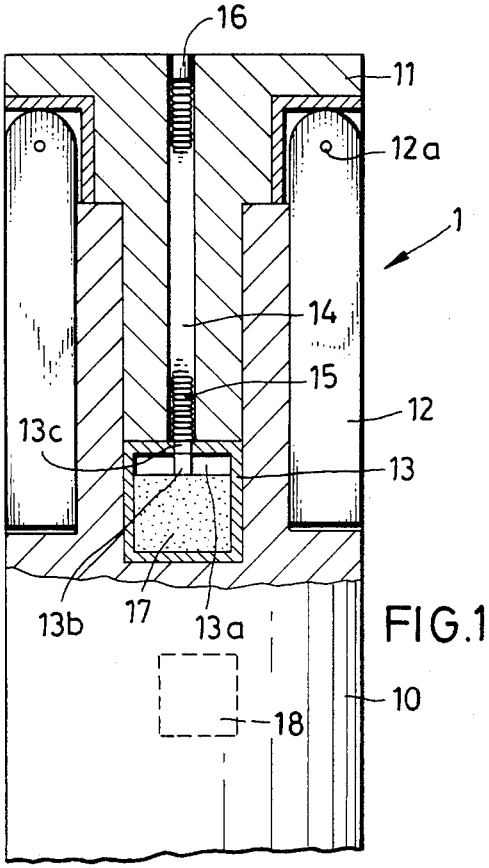
FIG. 1 is a partial longitudinal section of the tail area of a projectile according to a preferred embodiment of the invention.
Figure 3:
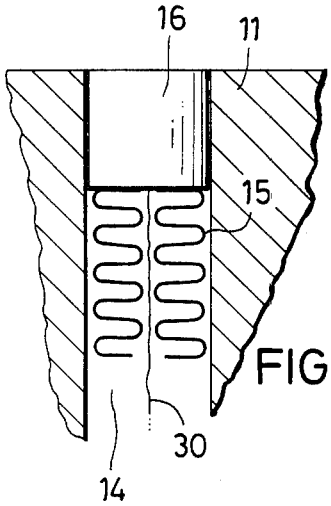
FIG. 3 is an enlarged partial view of the parts of the projectile according to FIG. 1, namely a sensor and a sensor carrier.
Figure 2:
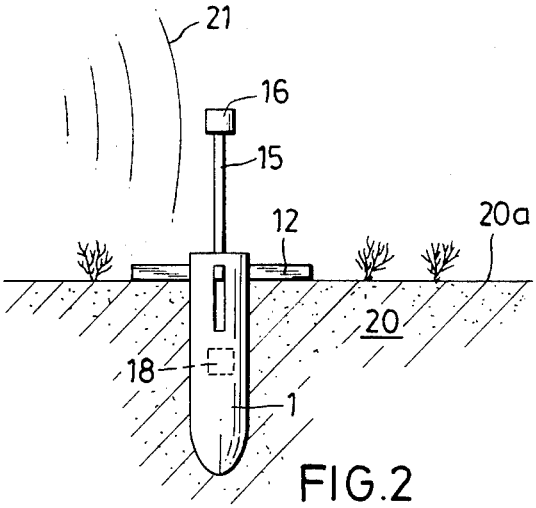
FIG. 2 is a schematic illustration of a projectile according to the invention embedded in the ground in the target area with a deployed sensor.
Figure 4:
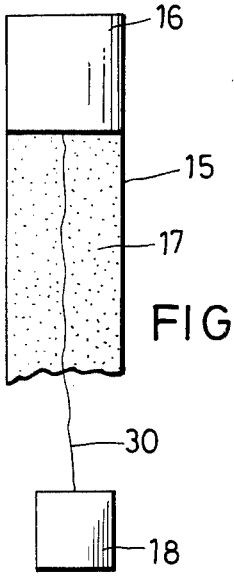
FIG. 4 is an enlarged partial view of parts of the projectile in accordance with FIG. 1, namely a sensor and a sensor carrier in the deployed state.

In general, FIG. 1 only shows in a schematic view the tail area of a payload-carrying projectile 1 in a state of rest. The payload-carrying projectile 1 is stabilized by vanes or fins and for this purpose, has a plurality of stabilizing vanes 12, retracted in the state of rest shown, which are pivotable around respective rotation axes 12*a*. Furthermore, the projectile 1 has a payload 18, which can be a transmit/receive device and/or an explosive charge. A recess 14 is provided in the tail section 11 of the projectile 1, in which is disposed a deployably stored sensor 16. As shown the recess 14 presents an axial bore found in the rear end surface of the projectile 1. This sensor 16 can be a sensitive accoustic-electrical transducer for converting sound waves into electrical signals, i.e. for instance a microphone or a magnetic field sensor or a detector sensitive to changes in an electrical field, or the like. During storage, firing, trajectory and at the time of impact in the target area, the sensor 16 is protectively disposed in the recess 14, so that it can sustain without damage all stresses which occur. After impact of the projectile 1 in the target area, however, it becomes necessary to deploy the sensor 16 from its protected place so that it extends as high as possible above the surface of the ground which has been penetrated by the projectile. To make this clear, FIG. 2 shows, in a schematic view, a payload-carrying projectile 1, which has penetrated the ground 20 in the target area, with a deployed sensor 16 which, supported by a sensor carrier 15, extends as high as possible above the surface 20*a* of the ground in order to, for instance, receive arriving sound waves 21 and to process them. The radially extended vanes 12, which stabilize the projectile 1 during flight, prevent too deep penetration of the projectile 1 into the ground 20 at impact, so that the sensor 16 can achieve as favorable a position as possible. A concertina or tubular type bellows is provided as the sensor carrier 15, and consists of plastic, rubber or a metal alloy with is flexibly elastic, such as, for instance, tombac. In the position of rest shown in FIG. 1 of the sensor 16 and the sensor carrier 15, the sensor carrier 15 is disposed as much compressed as possible in the recess 14 of the tail section 11 of the projectile 1. It is connected with a reservoir 13 which is disposed in the tail section 11 of the projectile 1, and which is filled with polyurethane foam 17 mixed with a propulsive gas under high pressure. The polyurethane foam 17 can, via a conduit 13*b* and a recess in the housing 13 and depending on the control position of a valve element 13*c* regulated by electronic control element 13*a*, penetrate into the interior of the sensor carrier 15. FIG. 3 shows an enlarged partial view of the sensor 16 and of the sensor carrier 15 connected with the sensor 16 in the position of rest shown in FIG. 1, in which the sensor 16 and the sensor carrier 15 are still located in the recess 14 within the tail section 11 of the projectile 1. The electronic control element 13*a* preferably includes an impact switch which opens the valve element 13*c* upon impact or a timer switch which, for instance, opens the valve element 13*c* after the expiration of a pre-set trajectory time, and permits the polyurethane foam 17 which is under high pressure to enter the sensor carrier 15, which thereby is extended and therefore expels the sensor 16 from the recess 14 in the tail section 11 of the projectile 1 in order to permit it to assume the position shown in FIG. 2. FIG. 4 shows an enlarged view of the sensor 16 in the position shown in FIG. 2, together with a part of the sensor carrier 15, now filled with the polyurethane foam 17 and thus completely extended. The polyurethane foam 17 hardens in a comparatively short period of time, thereby stiffening the sensor carrier 15 in its extended position, thus providing the sensor 16 with a sufficiently stable but, if necessary, elastically yielding support. The sensor 16 is connected with the payload 18 (FIG. 3, FIG. 4) via a cable 30 disposed within the sensor carrier 15, so that the signals received and, if necessary converted, by the sensor 16 can be transmitted to the payload 18.

In the position shown in FIG. 2 the sensor 16 is deployed from its protected position and is kept by the sensor carrier 15 as far above the surface 20*a* of the ground as possible and there receives, for instance, arriving sound waves 21. According to the intensity or sound spectrum of the arriving sound waves 21 an explosive charge, for instance provided as the payload 18, reacts to the sensor signals and thereby destroys a target which has come within attack range and which could, for instance, be a vehicle, especially a combat tank.

In another type of use the payload-carrying projectile 1 only serves for reconnaissance purposes. For this purpose the payload 18 consists of a high-frequency transmitter which transmits through radio channels the information gathered by the sensor 16 to a rear command post in order to determine the situation.

In this case the sensor carrier 15 is usefully employed as an aerial for the high-frequency transmitter provided as the payload 18.

What is claimed is:

1. A payload-carrying projectile comprising: a projectile having a recess formed in its tail section; a payload disposed within said projectile; a sensor for the payload mounted on a sensor carrier, with said sensor and said sensor carrier being disposed, in a protected manner, in said recess during firing of said projectile with said sensor carrier comprising a concertina type bellows having one end connected to said sensor, and being disposed in said recess in a compressed state; and means for deploying said sensor from said projectile including a reservoir disposed within said projectile and containing polyurethane foam mixed with a propellant gas under high pressure with said reservoir being connected via an opening, which is closable by a valve element, with the other end of said concertina type bellows.

2. A payload-carrying projectile in accordance with claim 1 wherein said means for deploying further includes an electronic control element, disposed inside said projectile, for controlling said valve element to open same after impact of said projectile in a target area.

3. A payload-carrying projectile in accordance with claim 1 wherein said recess is formed in a rear end surface of said projectile.

4. A payload-carrying projectile in accordance with claim 3 wherein said projectile is provided with a plurality of stabilizing vanes which are pivotably mounted on said tail section of said projectile adjacent said rear end surface and which extend radially from the periphery of said tail section after firing of said projectile.

5. A payload-carrying projectile in accordance with claim 2, wherein said electronic control element includes a delay switch.

6. A payload-carrying projectile in accordance with claim 1 wherein said sensor is connected with said payload by means of a cable.

7. A payload-carrying projectile in accordance with claim 6 wherein said cable is routed through the sensor carrier.

8. A payload-carrying projectile in accordance with claim 2 wherein said electronic control element (13*a*) includes an impact switch.

9. A payload-carrying projectile in accordance with claim 8 wherein the sensor is connected with the payload by means of a cable.

10. A payload-carrying projectile in accordance with claim 2 wherein the sensor is connected with the payload by means of a cable.

11. A payload-carrying projectile in accordance with claim 5 wherein the sensor is connected with the payload by means of a cable.

12. A payload-carrying projectile in accordance with claim 11 wherein the cable is routed through the sensor carrier.

13. A payload-carrying projectile in accordance with claim 9 wherein the cable is routed through the sensor carrier.

14. A payload-carrying projectile in accordance with claim 10 wherein the cable is routed through the sensor carrier.

* * * * *